United States Patent [19]

Toman

[11] Patent Number: 4,682,551

[45] Date of Patent: Jul. 28, 1987

[54] MULTI-EMBLEM CLAMPING DEVICE

[75] Inventor: George M. Toman, Chicago, Ill.

[73] Assignee: Meistergram, Inc., Greensboro, N.C.

[21] Appl. No.: 728,927

[22] Filed: Apr. 30, 1985

[51] Int. Cl.[4] ..... D05B 31/00; D06C 3/08

[52] U.S. Cl. ..... 112/103; 112/121.12; 38/102.91; 160/380; 33/562

[58] Field of Search ..... 21/121.12, 121.15, 103, 21/119, 260, 114, 136, 70, 76; 38/102.1, 102.2, 102.91; 33/562, 12, 13; 2/243 B; 28/151, 152; 434/95, 96; 269/254 R; 160/378, 380

[56] References Cited

U.S. PATENT DOCUMENTS

| | | | |
|---|---|---|---|
| 875,622 | 12/1907 | Parkes | 112/70 |
| 1,032,839 | 7/1912 | Kemler | 160/380 X |
| 2,574,064 | 11/1951 | Rosen | 434/95 |
| 3,034,458 | 5/1962 | Bennison | 112/121.12 |
| 3,216,383 | 11/1965 | Bono | 112/121.12 X |
| 3,599,583 | 8/1971 | Berman | 112/121.12 |
| 3,732,638 | 5/1973 | Hanley | 38/102.91 |
| 3,749,038 | 7/1973 | Dodsworth | 112/121.15 |
| 4,485,574 | 12/1984 | Bennetot | 112/103 |
| 4,497,266 | 2/1985 | Fujita et al. | 112/121.12 X |

*Primary Examiner*—Werner H. Schroeder
*Assistant Examiner*—Andrew M. Falik
*Attorney, Agent, or Firm*—James A. Hudak

[57] ABSTRACT

A device for clamping a multiplicity of emblems to be monogrammed or embroidered receives and positions the emblems in an assembly comprising a base plate, an emblem insert plate, and a clearance plate. A clip plate and a cover plate are hingedly attached to the base plate and the emblem insert plate. Aligned apertures are provided in all of the plates permitting access by the sewing needle to the emblem held within the device. A plurality of projections is provided around the periphery of each aperture in the clip plate to grippingly engage the edge of each emblem to be monogrammed or embroidered. The cover plate is formed so as to apply a substantially constant pressure across the clip plate and to the projections provided therein.

4 Claims, 6 Drawing Figures

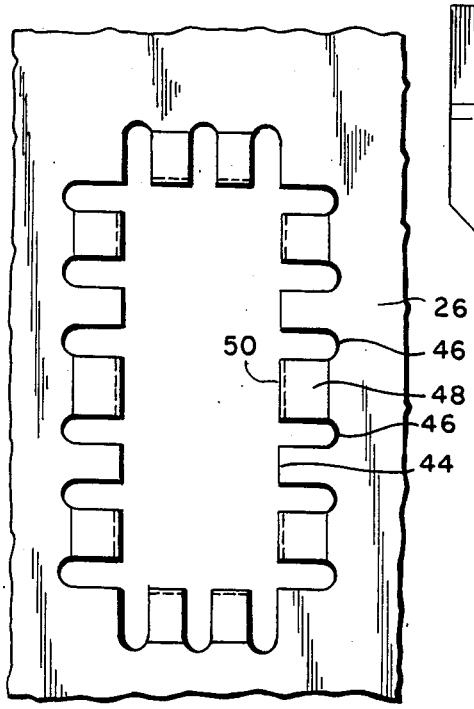
Fig. 2
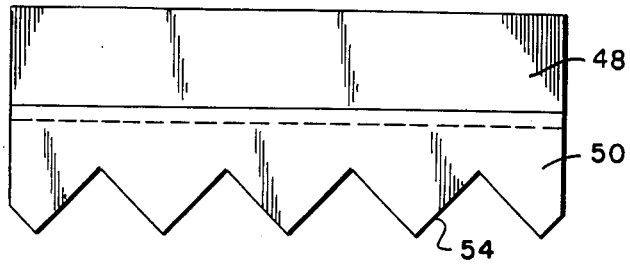
Fig. 4
Fig. 3
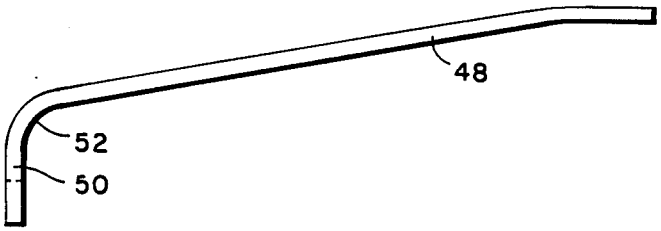
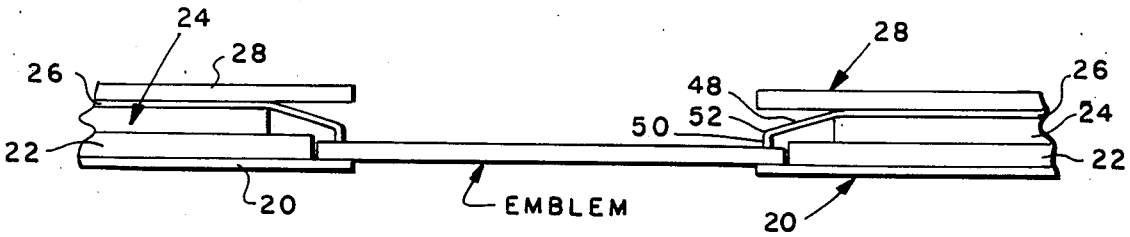
Fig. 5
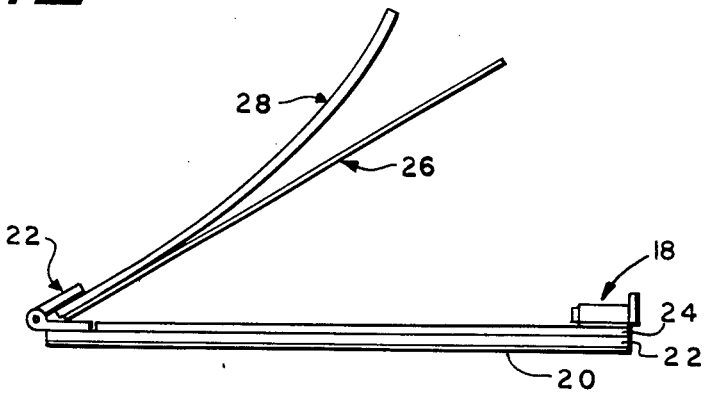
Fig. 6

MULTI-EMBLEM CLAMPING DEVICE

TECHNICAL FIELD

The present invention pertains to a device for holding emblems when being monogrammed or embroidered, and more particularly to a device for holding a multiplicity of emblems in a predetermined spaced-apart relationship during the monogramming or embroidering process.

BACKGROUND ART

Various devices have been developed for holding material or materials in registration during the sewing process. These devices are typically designed for specific applications, such as for the sewing of pockets or cuffs on shirts, collars on jackets, or for the monogramming of ties, etc. Such devices improve registration accuracy, but it has been determined that the time required for loading and unloading the material or materials into the device can equal or exceed the time required for the actual sewing process. Because of this, considerable effort has been directed to developing clamps and/or pallets which can accommodate multiple pieces of material to be sewn. By accommodating multiple pieces of material, the ratio of the time required for loading and unloading the material versus the actual sewing time is substantially reduced. However, it has been found that even though the use of clamps or pallets reduces the foregoing ratio and thus increases productivity, it creates other problems with respect to maintaining registration of the material during the sewing process and adapting the clamp or pallet to the sewing machine involved.

In order to maintain precise registration of the material or materials within the clamp or pallet, a sufficient clamping force must be applied to the material or materials and this force must be substantially uniform around the periphery thereof. However, during the sewing process, the sewing machine imposes various forces on the material or materials which can impair registration unless a sufficient uniform clamping force is maintained. For example, when the needle is being withdrawn from the material or during stitch setting, the material is pulled upwardly away from the throat plate of the sewing machine. Also, the actual sewing process imposes a horizontal force on the material in the direction of sewing. Furthermore, some sewing systems actually feed the material continuously which results in the material being moved when the needle is still in the material. It has been found that the clamps and pallets presently available do not provide a sufficient clamping force on the material or materials to overcome the foregoing forces, and thus registration of the material or materials during the sewing process is virtually impossible to maintain.

Due to the wide variety of sewing machines available, the clamp or pallet must be designed so as to be readily adaptable to most machines. However, conventional sewing machines have design limitations with respect to the height of the needle and the presser foot, and the size of the underarm space. The foregoing parameters limit the size, shape and overall height of the clamp or pallet, particularly when in the closed position. Here again, it has been found that the design of clamps and pallets presently available is such that they are not easily adaptable to many sewing machines, thus preventing the use of the clamps or pallets with such machines.

Because of the foregoing, it has become desirable to develop a clamping device which can retain a multiplicity of pieces of material in registration during the sewing process, and which is easily adaptable for use with a wide range of sewing machines.

SUMMARY OF THE INVENTION

The present invention solves the aforementioned problems associated with the prior art as well as other problems by providing a device for uniformly clamping a multiplicity of emblems to be monogrammed or embroidered. The device is comprised of a bottom assembly including a base plate, an emblem insert plate and a clearance plate which are fastened together and which have aligned apertures provided therein sized so as to receive, position and support the emblems to be monogrammed or embroidered; a top assembly including a clip plate and a cover plate which have aligned apertures therein; and a hinge arrangement which attaches the bottom assembly to the top assembly. When in use, the apertures within the base plate, emblem insert plate, clearance plate, clip plate and the cover plate, are all aligned permitting the needle of the sewing machine to contact the emblem to be monogrammed or embroidered through the apertures. The periphery of each aperture in the clip plate has notches provided therein forming a plurality of spring-like projections which grippingly engage the edge of each emblem to be monogrammed or embroidered. The cover plate has a downwardly directed convex bow formed therein causing a substantially uniform compressive force to be applied across the clip plate which, in turn, transmits a substantially constant pressure to the spring-like projections and to the emblems being held within the device. A latching mechanism is provided to keep the device in a closed position during the monogramming or embroidering process.

BRIEF DESCRIPTION OF THE DRAWINGS

FIG. 2 is an enlarged top plan view of a portion of the clip plate utilized in the present invention.

FIG. 3 is a front elevation view of a bent projection on the clip plate shown in FIG. 2.

FIG. 4 is a side view of a bent projection on the clip plate as viewed from the left of FIG. 3.

FIG. 5 is a partial cross-sectional view of the present invention illustrating the aligned apertures when the invention is in the closed position.

FIG. 6 is a front elevation view of the invention when in the open position.

DESCRIPTION OF THE PREFERRED EMBODIMENT

Figure 1:
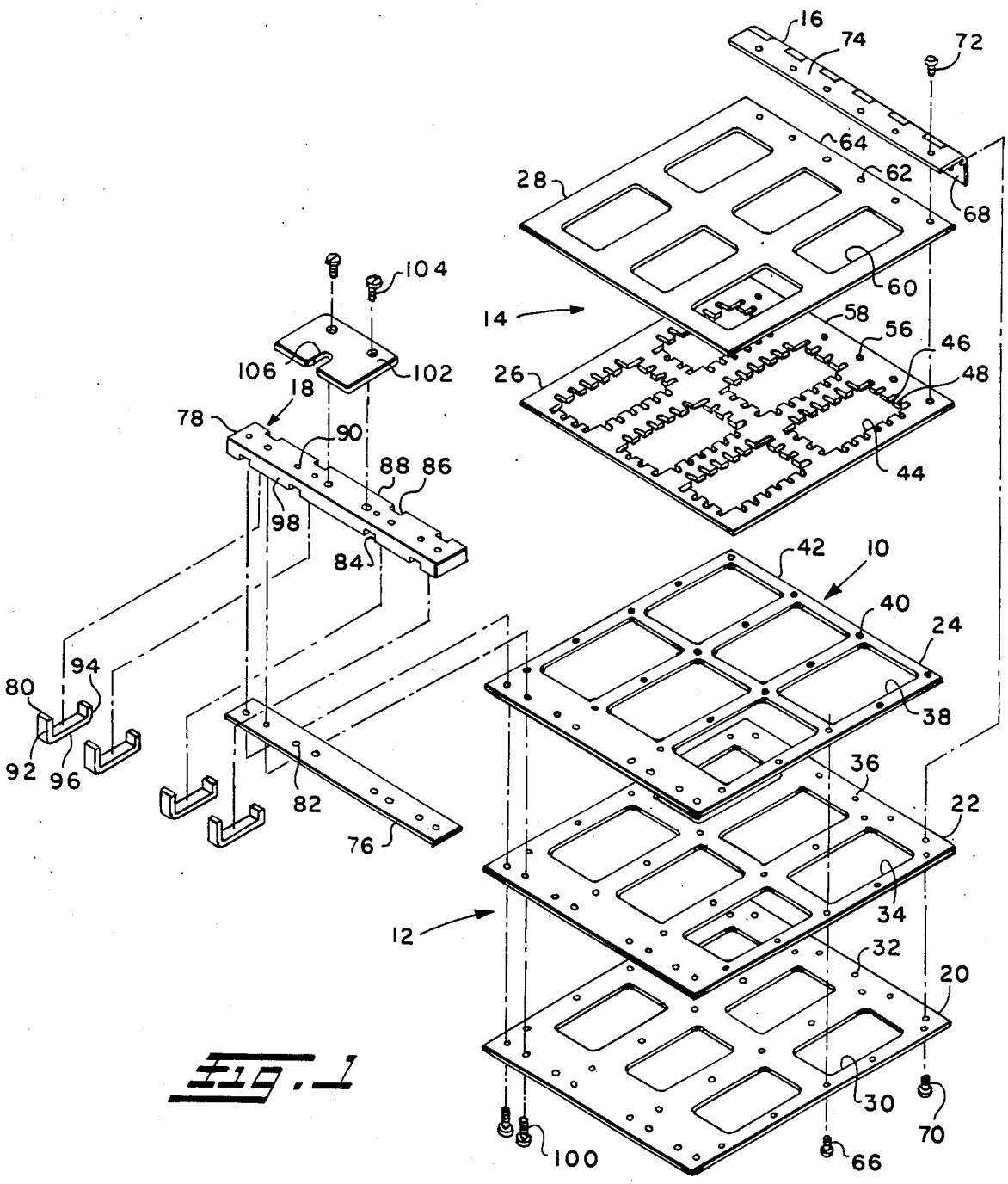
FIG. 1 is an exploded perspective view of the present invention.

Referring now to the drawings where the illustrations are for the purpose of describing the preferred embodiment of the present invention and are not intended to limit the invention hereto, FIG. 1 is an exploded perspective view of a multi-emblem clamping device 10 comprising a bottom assembly 12 and a top assembly 14 held together by a hinge 16 and a latch assembly, generally referred to as numeral 18. The bottom assembly 12 includes a base plate 20, an emblem insert plate 22 and a clearance plate 24, and the top assembly includes a clip plate 26 and a cover plate 28.

The base plate 20 is formed from a metallic sheet material, such as stainless steel, and has a plurality of apertures 30 formed therein. The sheet material utilized for the base plate 20 must have sufficient stiffness to prevent bending of the bottom assembly 12 when the clamping device 10 is in use and to act in conjunction with the cover plate 28 to apply a uniformly distributed compressive force to the emblems held within the device, as hereinafter described. Each of the apertures 30 has a configuration similar to that of the emblems to be held by the clamping device 10, the inner dimensions of the apertures 30 being slightly smaller than the corresponding outer dimensions of the emblems to be held. The apertures 30 are positioned within the base plate 20 so as to be relatively evenly spaced with respect to one another, however, such even spacing is not imperative. A plurality of apertures 32 is provided adjacent the outer periphery of the base plate 20 and between the apertures 30 in the base plate 20 for the purpose of fastening the bottom assembly 12 together and for attaching same to the top assembly 14, as hereinafter described.

The emblem insert plate 22 is also formed from a metallic sheet material, such as aluminum, and has a plurality of apertures 34 formed therein. Each of the apertures 34 has a configuration identical to the emblems to be held by the device 10 and the inner dimensions of the apertures 34 are slightly greater than the corresponding outer dimensions of the emblems to be held. The position of the apertures 34 within the emblem insert plate 22 is such that the apertures 34 are in alignment with the apertures 30 in the base plate 20 when the bottom assembly 12 is fastened together. The length and width of the emblem insert plate 22 are similar to that of the base plate 20, and the thickness of the emblem insert plate 22 is greater than the thickness of the emblems to be held allowing the emblems to be fully received within the apertures 34. A plurality of apertures 36 is provided adjacent the outer periphery of the emblem insert plate 22 and between the apertures 34 in the insert plate 22. These apertures 36 are aligned with the apertures 32 in the base plate 20 to allow for the fastening of the bottom assembly 12 together and for attaching same to the top assembly 14.

The clearance plate 24 is similar to the base plate 20 and the emblem insert plate 22 in that is is formed from a metallic sheet material, such as aluminum, and has a plurality of apertures 38 provided therein. Each of the apertures 38 has a configuration similar to that of the apertures 30 and 34 provided in the base plate 20 and the emblem insert plate 22, respectively, and the inner dimensions of the apertures 38 are slightly greater than the inner dimensions of the apertures 34. The position of the apertures 38 within the clearance plate 24 is such that the apertures 38 are in alignment with the apertures 34 in the emblem insert plate 22 and the apertures 30 in the base plate 20 when the bottom assembly 12 is fastened together. The thickness of the clearance plate 24 is comparable to that of the emblem insert plate 22. A plurality of apertures 40 is provided adjacent the outer periphery of the clearance plate 24 and between the apertures 38 in the plate 24. These apertures 40 are aligned with the apertures 36, 32 in the emblem insert plate 22 and the base plate 20, respectively to permit fastening of the bottom assembly 12 together. It should be noted that the width of the clearance plate 24 is similar to the width of both the emblem insert plate 22 and the base plate 20, but the length of the clearance plate 24 is less than the length of the base plate 20 and the emblem insert plate 22 resulting in one less row of apertures 40 adjacent the edge 42 of the clearance plate 24.

The clip plate 26, which is a biasing member, is formed from a half-hard stainless steel strip material and has a plurality of apertures 44 formed therein. As shown in FIG. 2, the periphery of each aperture 44 has a plurality of notches 46 formed therein causing a inwardly directed projecticn 48 to be formed between each pair of adjacent notches 46. Each of the apertures 44, prior to the formation of the notches 46 therein, has a configuration similar to that of the emblems to be held by the device 10. The position of the apertures 44 within the clip plate 26 is such that the apertures 44 are in alignment with the apertures 38, 34 and 30 in the clearance plate 24, the emblem insert plate 22 and the base plate 20, respectively when the device 10 is in use. The projections 48 on the sides of each aperture 44 are alternatively bent slightly downwardly at the bottom of the adjacent notches 46 causing the plane of those projections 48 that are so bent to be at an angle of approximately 10° with respect to the plane of the clip plate 26. The tip of each of these bent projections 48 is formed downwardly at point 52 with respect to the plane of the bent projection 48 so that the plane of the tip 50 is substantially perpendicular to the plane of the clip plate 26 and an obtuse included angle is formed on the underside of the bent projection 48 at point 52, as shown in FIG. 3. Serrations 54 are provided on the end of each of the tips 50 to grippingly engage the emblem held within each of apertures 34 in the emblem insert plate 22, as illustrated in FIG. 4. The length of each of the bent projections 48 is such that when the clamping device 10 is assembled, the bottom of each notch 46 is adjacent the surface defining the aperture 38 in the clearance plate 24. In addition, the tip 50 of each of these bent projections is in a spaced-apart parallel relationship with the surfaces defining the apertures 38, 34 in the clearance plate 24 and the emblem insert plate 22, respectively, and the serrations 54 on the end of each tip 50 is contacting the top surface of the base plate 20, as shown in FIG. 5. It should be noted that the remaining projections 48, i.e., those projections that are not bent, remain in the same plane as that of the clip plate 26 and provide support thereto thus minimizing the possibility of accidental bending of the clip plate 26. A plurality of apertures 56 is provided adjacent the edge 58 of the clip plate 26 for the purpose of fastening the top assembly 14 together and for attaching same to the bottom assembly 12, as hereinafter described.

The cover plate 28 is formed from a metallic sheet material, such as stainless steel, and, as shown in FIG. 6, has a downwardly directed convex bow formed therein so as to apply a substantially uniform compressive force across the clip plate 26 and the clearance plate 24 when the device is in use. A plurality of apertures 60, having a configuration similar to that of the emblems to be held, is formed in the cover plate 28. The position of the apertures 60 within the cover plate 28 is such that the apertures are in alignment with the apertures 44, 38, 34 and 30 in the clip plate 26, the clearance plate 24, the emblem insert plate 22 and the base plate 20, respectively, when the device 10 is in use. The inner dimensions of the apertures 60 are approximately the same as the inner dimensions of the apertures 30 in the base plate 20 so that the clip plate 26, the clearance plate 24 and the emblem insert plate 22 are covered by the cover plate 28 when the device 10 is in a closed position. A plurality of apertures 62 is provided adjacent the edge 64 of the cover plate 28 so as to be in alignment with the apertures 56 in the clip plate 26 to allow for the fastening of the top assembly 14 together and for fastening same to the bottom assembly 12.

The bottom assembly 12 is fastened together by means of rivets 66 which are received through those apertures 32, 36 and 40 which are located between and immediately adjacent the apertures 30, 34 and 38 provided in the base plate 20, the emblem insert plate 22 and the clearance plate 24, respectively so as to form a laminated construction. It should be noted that the bottom assembly 12 could be formed from a single piece of metallic material rather than being a laminated construction, however, such a one-piece construction is costly to produce because of the extensive machining required for same. One leaf 68 of the hinge 16 is attached to the bottom assembly 12 by means of rivets 70 which are received through the apertures 32 and 36 provided adjacent one width-wise edge of the base plate 20 and the emblem insert plate 22, respectively. The top assembly 14 is fastened together and attached to the bottom assembly 12 by means of rivets 72 which are received through the other leaf 74 of the hinge 16 and through the apertures 62 and 56 provided in the cover plate 28 and the clip plate 26, respectively.

The latch assembly 18 is comprised of a spacer strip 76, a connector block 78, and a plurality of latches 80 retained within the connector block 78. The spacer strip 76 is formed from a metallic sheet material, such as aluminum, and has a plurality of apertures 82 provided therein. The position of the apertures 82 in the spacer strip 76 is such so as to be in alignment with the apertures 32, 36 and 40 provided adjacent the other width-wise edge of the base plate 20, the emblem insert plate 22 and the clearance plate 24, respectively. The connector block 78 is formed from a metallic bar material, such as aluminum, and has a plurality of recesses 84, substantially rectangular in cross-section, on the underside thereof. Each recess 84 terminates in a similarly shaped recess 86 provided in the inner edge 88 of the connector block 78 and in the top surface thereof. A plurality of apertures 90 is provided in the connector block 78. These apertures 90 are aligned with the apertures 82 in the spacer strip 76. The latches 80 are formed from a material, such as aluminum, with a generally rectangular cross-section and having a width and thickness such that they can be received within and slidingly engage the recess 84 provided in the connector block 78. Each latch 80 is formed into a U-shape with a longer leg 92, a shorter leg 94, and a base portion 96 connecting the foregoing legs. The transverse length of the base portion 96 of each latch 80 is greater than the width of the connector block 78; the height of the longer leg 92 of each latch 80 is greater than the thickness of the connector block 78; and the height of the shorter leg 94 of each latch 80 is approximately the same as the thickness of the connector block 78. A latch 80 is provided for each of the recesses 84 in the connector block 78 and is received within the recess 84 so that its base portion 96 slidingly engages the recess 84, its longer leg 92 is adjacent the outer edge 98 of the connector block 78, and its shorter leg 94 is adjacent the inner edge 88 of the connector block 78 and receivable within the corresponding recess 86 provided in the block 78.

The foregoing latch assembly 18 is attached to the clamping device 10 by means of rivets 100 which are received through the apertures 32, 36 and 40 provided adjacent the other width-wise edge of the base plate 20, the emblem insert plate 22 and the clearance plate 24, respectively, and through the apertures 82 and 90 provided in the spacer strip 76 and the connector block 78, respectively; the connector block 78 containing the latches 80 in the orientation previously described. A hoop connecting plate 102 is attached to the top surface of the connector block 78 by screws 104 or other fastening means. The hoop connecting plate 102 has a notch 106 formed therein which is positioned so as to extend outwardly from the outer edge 98 of the connector block 78. This notch 106 is used for attaching the clamping device 10 to the table drive mechanism (not shown) for the emblem monogramming or embroidering machine.

In order to use the clamping device 10, the top assembly 14 comprising the cover plate 28 and the clip plate 26 is swung upwardly so as to expose the bottom assembly 12 comprising the clearance plate 24, the emblem insert plate 22 and the base plate 20. The emblems to be monogrammed or embroidered are then inserted into the apertures 34 provided in the emblem insert plate 22. The bottom edge of the emblems contact the portion of the base plate 20 adjacent the apertures 30 provided therein preventing the emblems from falling through the apertures 30. The cover plate 28 and the clip plate 26 which is attached thereto are then swung downwardly to close the clamping device 10 causing the serrations 54 on the tips 50 of those projections 48 that are bent to come into contact with the top edge of each emblem which is supported by the portion of the base plate 20 adjacent the apertures 30. As the clamping device 10 is being closed, the cover plate 28 contacts the clip plate 26 causing the projections that are bent to grippingly engage and apply a compressive force, through the serrations 54 on each tip 50 thereof, to the top edge of each emblem so as to secure same. During the foregoing closing process, the projections 48 that are bent deflect slightly upwardly as the serrations 54 on each tip 50 engage the top edge of the emblem. The foregoing deflection causes the projections 48 that are bent to apply a compressive force to the emblems being held. In addition, the deflection allows the thickness of the emblems to vary since such variation is compensated for by the amount of deflection of each bent projection 48. After the clamping device 10 has been closed, each latch 80 is moved laterally so that the underside thereof contacts the top surface of the cover plate 28 adjacent the inner edge 88 of the connector block 78. Inasmuch as the cover plate 28 has a downwardly directed convex bow provided therein, the cover plate 28 provides a relatively uniform pressure across the clip plate 26 which, in turn, transmits a relatively uniform pressure to the bent projections 48 thereon. The bent projections 48, via the serrations 54 on their respective tips 50, apply a relatively uniform compressive force to the edge of the emblems being held within the clamping device 10. In this manner, the emblems are securely retained in the clamping device for monogramming or embroidering purposes. After the monogramming or embroidering process has been completed, each latch 76 is moved laterally so that the underside thereof disengages the top surface of the cover plate 28 and the shorter leg 94 of each latch 80 is received in its complementary recess 86 provided in the inner edge 88 of the connector block 78. Thus lateral movement of the latches 80 allows the cover plate 28 and the clip plate 26 which is attached thereto to be swung upwardly permitting the removal of the emblems from the clamping device 10.

Even though the foregoing discussion has been directed to holding a single thickness of material, such as an emblem, the clamping device 10 can be used for holding two or more thicknesses of material in registration during the monogramming or embroidering process. For example, it can be used for holding an emblem and backing material in registration so that the backing material can be attached to the emblem during the monogramming or embroidering process. Thus, the clamping device 10 is extremely versatile and has numerous applications.

Certain modifications and improvements will occur to those skilled in the art upon reading the foregoing, it should be understood that all such modifications and improvements have been deleted herein for the sake of conciseness and readability, but are properly within the scope of the following claims.

I claim:

1. A device for holding material in registration during the sewing process comprising:

means for receiving the material to be held in registration, said receiving means supporting the material and having at least one aperture therein; and means for grippingly engaging the material around the outer periphery thereof, said engaging means having at least one aperture therein in alignment with said at least one aperture in said receiving means permitting the passage of a sewing instrument therethrough during the sewing process, said engaging means including a plurality of projections directed inwardly toward the center of said at least one aperture therein, each of said projections having an end positioned substantially perpendicularly to the plane of said engaging means and engageable with the material, said plurality of projections being formed and positioned so as to apply a substantially even compressive force to the material.

2. A device for holding material in registration during the sewing process comprising:

means for receiving the material to be held in registration, said receiving means supporting the material and having at least one aperture therein; and means for grippingly engaging the material around the outer periphery thereof, said engaging means comprising a cover member and a biasing member each having at least one aperture therein in alignment with one another and in alignment with said at least one aperture in said receiving means permiting the passage of a sewing instrument therethrough during the sewing process, said biasing member having a plurality of inwardly directed projections around the periphery of said at least one aperture therein, each of said inwardly directed projections having an end positioned substantially perpendicularly to the plane of said biasing member and engageable with the material around the outer periphery thereof, said plurality of inwardly directed projections being formed so as to apply a substantially even compressive force to the material around the outer periphery thereof.

3. A device for holding material in registration during the sewing process comprising:

means for receiving the material to be held in registration, said receiving means supporting the material and having at least one aperture therein; and means for grippingly engaging the material around the outer periphery thereof, said engaging means comprising a cover member and a biasing member each having at least one aperture therein in alignment with one another and in alignment with said at least one aperture in said receiving means permitting the passage of a sewing instrument therethrough during the sewing process, said cover member being formed so as to apply a substantially even compressive force to said biasing member, said biasing member having a plurality of projections around the periphery of said at least one aperture therein, said plurality of projections being engageable with the material around the outer periphery thereof and being formed so as to apply a substantially even compressive force to the material around the outer periphery thereof.

4. A device for holding material in registration during the sewing process comprising:

means for receiving the material to be held in registration, said receiving means supporting the material and having at least one aperture therein; and means for grippingly engaging the material around the outer periphery thereof, said engaging means comprising a cover member and a biasing member each having at least one aperture therein in alignment with one another and in alignment with said at least one aperture in said receiving means permitting the passage of a sewing instrument therethrough during the sewing process, said cover member having a downwardly directed convex bow formed therein so as to apply a substantially even compressive force to said biasing member, said biasing member having a plurality of projections around the periphery of said at least one aperture therein, said plurality of projections being engageable with the material around the outer periphery therof and being formed so as to apply a substantially even compressive force to the material around the outer periphery thereof.

* * * * *